US006000794A

United States Patent [19]

Kondo et al.

[11] Patent Number: 6,000,794

[45] Date of Patent: Dec. 14, 1999

[54] IMAGE FORMING METHOD

[75] Inventors: Yuji Kondo, Machida; Hitoshi Yoshino, Zama, both of Japan

[73] Assignee: Canon Kabushiki Kaisha, Tokyo, Japan

[21] Appl. No.: 08/911,052

[22] Filed: Aug. 14, 1997

Related U.S. Application Data

[62] Division of application No. 08/546,075, Oct. 20, 1995, Pat. No. 5,679,451.

[30] Foreign Application Priority Data

Oct. 27, 1994 [JP] Japan ..... 6-263715
Sep. 12, 1995 [JP] Japan ..... 7-233928

[51] Int. Cl.[6] ..... B41M 5/00; B41J 2/01

[52] U.S. Cl. ..... 347/105; 428/195; 428/304.4; 428/323; 428/328; 428/331; 428/409

[58] Field of Search ..... 428/195, 323, 428/328, 331, 409, 304.4; 347/105

[56] References Cited

U.S. PATENT DOCUMENTS

| | | | |
|---|---|---|---|
| 4,202,870 | 5/1980 | Weber et al. | 423/630 |
| 4,242,271 | 12/1980 | Weber et al. | 260/448 AD |
| 4,374,804 | 2/1983 | Easter, II | 422/184 |
| 4,879,166 | 11/1989 | Misuda et al. | 428/212 |
| 5,013,603 | 5/1991 | Ogawa et al. | 428/331 |
| 5,104,730 | 4/1992 | Misuda et al. | 428/304.4 |
| 5,635,291 | 6/1997 | Yoshino et al. | 428/304.4 |

FOREIGN PATENT DOCUMENTS

| | | |
|---|---|---|
| 0331125 | 6/1989 | European Pat. Off. . |
| 0411638 | 2/1991 | European Pat. Off. . |
| 0450540 | 10/1991 | European Pat. Off. . |
| 54-59936 | 5/1979 | Japan . |
| 55-5830 | 1/1980 | Japan . |
| 55-51583 | 4/1980 | Japan . |
| 55-14686 | 11/1980 | Japan . |
| 58-110287 | 6/1983 | Japan . |
| 1-9768 | 4/1989 | Japan . |
| 2-276670 | 11/1990 | Japan . |
| 2-276671 | 11/1990 | Japan . |
| 3-275378 | 12/1991 | Japan . |
| 3-281384 | 12/1991 | Japan . |
| 4-37576 | 2/1992 | Japan . |
| 5-32037 | 2/1993 | Japan . |
| 5-125437 | 5/1993 | Japan . |
| 5-125438 | 5/1993 | Japan . |
| 5-125439 | 5/1993 | Japan . |
| 6-114571 | 4/1994 | Japan . |

*Primary Examiner*—Pamela R. Schwartz
*Attorney, Agent, or Firm*—Fitzpatrick, Cella, Harper & Scinto

[57] ABSTRACT

Provided is a recording medium comprising a base material, and an ink-receiving layer thereon containing a pigment having an aggregated-particle diameter of from 0.5 to 50 $\mu$m and a binder, wherein said ink-receiving layer has a value of BET specific surface area/pore volume within the range of from 50 to 500 $m^2$/ml.

28 Claims, 1 Drawing Sheet

IMAGE FORMING METHOD

This application is a division of application Ser. No. 08/546,075 filed Oct. 20, 1995 now U.S. Pat. No. 5,679,451.

BACKGROUND OF THE INVENTION

1. Field of the Invention

This invention relates to a recording medium suited for recording carried out using a water-based ink, and an image forming method and a printed material which make use of the recording medium. More particularly, it relates to a recording medium that may hardly cause beading, and an image forming method and a printed material which make use of such a recording medium.

2. Related Background Art

In recent years, ink-jet recording, which is a system used to record images, characters or letters and so forth by causing minute ink droplets to fly utilizing various types of drive mechanisms and adhere to a recording medium such as paper, has rapidly spread in various uses including information equipment as apparatus for recording various types of images, because of the features such that the recording can be performed at high speed and low noise, multi-color recording can be achieved with ease, recording patterns can be of great flexibility and neither development nor fixing is required. The ink-jet recording is also being widely put in practical use in the field of full-color image recording, because images formed by multi-color ink-jet recording can be recorded as images comparable to multi-color prints obtained by lithography or prints formed by color photography, and at a lower cost than those obtained by conventional multi-color printing or color photography, when a small number of printed materials are prepared. Recording apparatus and recording processes have been improved with progress in recording performances, e.g., with achievement of higher recording speed, higher minuteness and full-color recording. With regard to recording mediums, too, it has become required for them to have high-level properties.

To meet such requirements, forms of recording mediums have been hitherto proposed in great variety. For example, Japanese Patent Application Laid-open No. 55-5830 discloses an ink-jet recording paper provided on the surface of its support with an ink-absorptive coat layer. Japanese Patent Application Laid-open No. 55-51583 discloses an example in which noncrystal silica is used as a pigment in a coating layer; and also Japanese Patent Application Laid-open No. 55-146786, an example in which a water-soluble polymer coat layer is used.

In recent years, a recording medium having a coat layer formed using an alumina hydrate of Boehmite structure, as disclosed in, e.g., U.S. Pat. No. 4,879,166 and U.S. Pat. No. 5,104,730 and Japanese Patent Applications Laid-open No. 2-276670, No. 3-275378, No. 3-281384 and No. 5-32037.

As also disclosed in U.S. Pat. No. 4,374,804 and U.S. Pat. No. 5,104,730 and Japanese Patent Applications Laid-open No. 58-110287, No. 1-97678, No. 2-276671 and No. 4-37576, it is also proposed to form an ink receiving layer of multi-layer construction by the use of a silica or alumina material.

All the proposals, however, are concerned with improvements of ink absorptivity, resolution, image density, color performance, color reproducibility, ink adsorptivity, transparency and so forth. Even such proposals bring about no improvement or settlement good enough to be satisfactory in respect of beading.

Especially when a large quantity of ink is imparted at one time to substantially the same portion of a recording medium as in the case of high-speed full-color recording, it is difficult to prevent the beading well enough to be satisfactory.

According to a finding of the present inventors, the prior art recording mediums have proved to cause beading when subjected to printing which imparts 30 ng of ink at 32×32 dots per 1 $mm^2$.

Herein, the beading refers to a phenomenon that occurs because of an insufficient ink absorptivity of recording mediums and is, after printing, visually recognized as color uneveness shaped like beads.

With regard to the ink absorptivity, its improvement has been made in the above prior art from the viewpoint of pore volume and pore radius, but there is no disclosure as to the beading. Also, the problem of beading can not be well settled if only both the pore volume and the pore radius are taken into account.

For example, U.S. Pat. No. 5,104,730 and Japanese Patent Applications Laid-open No. 2-276670, No. 2-276671 and No. 3-275378 disclose a recording medium having a narrow pore size distribution of 1.0 to 3.0 nm as average pore diameter. Such pore size distribution is attributable to good adsorption of dyes, but can not provide sufficient solvent absorptivity to tend to cause beading.

Japanese Patent Application Laid-open No. 3-281384 also discloses an alumina hydrate that has the shape of columns with an aspect ratio of 3 or less and forms hair-bundlelike assemblages oriented in a given direction, and a method of forming an ink-receiving layer having good ink absorptivity and color performance by the use of such an alumina hydrate. However, since particles of the alumina hydrate are oriented and densely packed, the gaps between particles of the alumina hydrate in the ink-receiving layer tend to be narrow. Hence, there is the tendency that the pore diameter is one-sided toward the narrow side and the pore size distribution is narrow.

SUMMARY OF THE INVENTION

Accordingly, the present invention was made in order to solve the above problems. An object of the present invention is to provide a recording medium that can satisfy various performances such as ink absorptivity, image density, anti-bleeding and water fastness and may hardly cause beading, and an image forming method and a printed material which make use of such a recording medium.

The above object can be achieved by the invention described below.

According to the present invention, there is provided a recording medium comprising a base material, and an ink-receiving layer thereon containing a pigment having an aggregated-particle diameter of from 0.5 to 50 $\mu$m and a binder, wherein the ink-receiving layer has a value of BET specific surface area/pore volume within the range of from 50 to 500 $m^2$/ml.

According to the present invention, there is provided also an image forming method comprising ejecting minute droplets of an ink from fine orifices to impart the ink droplets to a recording medium to make a print, wherein the recording medium described above is used.

According to the present invention, there is further provided a printed material prepared by the image forming method described above.

BRIEF DESCRIPTION OF THE DRAWINGS

FIGS. 2A-1 and 2A-2 are diagrammatic cross sections to show how pores stand in the ink-receiving layer in the recording medium of the present invention.

FIGS. 2B-1 and 2B-2 are partial enlarged views of inner wall surfaces of the pores shown in FIGS. 2A-1 and 2A-2, respectively.

DESCRIPTION OF THE PREFERRED EMBODIMENTS

According to findings of the present inventors, the beading occurs (1) when ink is absorbed into the ink-receiving layer at a low speed or (2) when ink is adsorbed in the ink-receiving layer at a low speed.

In the case of (1), it is considered that, since ink is absorbed into the ink-receiving layer at a low speed, the ink remaining on the surface of the ink-receiving layer comes together to turn beady, so that areas having a large ink quantity and areas having a small ink quantity are formed there, which are seen as density uneveness or color uneveness when observed after the ink has fixed.

In the case of (2), it is considered that, since ink is adsorbed in the ink-receiving layer at a low speed, the ink agglomerates in the ink-receiving layer, so that the ink is not uniformly adsorbed and density uneveness or color uneveness is produced as in the case of (2).

The present inventors have discovered that, in order to prevent the beading, it is important to take into account the relationship between pore volume and BET specific surface area, and thus have accomplished the present invention. None of the prior art has ever taken note of BET specific surface area in relation to the beading. "Anti-bleeding" used in the present invention means that a printed area does not bleed unnecessarily.

Preferred embodiments of the present invention will be described below.

Figure 1:
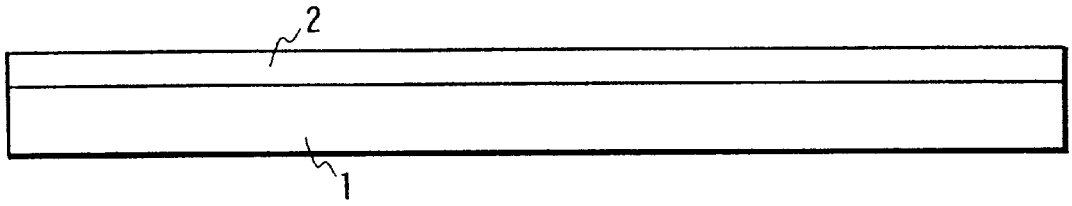
FIG. 1 is a cross section to illustrate an embodiment of the recording medium of the present invention.

The recording medium of the present invention has the structure as shown in FIG. 1, which comprises a base material 1 and formed thereon an ink-receiving layer 2 mainly composed of a pigment and a binder.

As a result of studies made by the present inventors, it has been found that the value of BET specific surface area/pore volume of the ink-receiving layer is very important in order to obtain a recording medium that may hardly cause beading. When this value is smaller, there is seen the tendency that the ink absorptivity and water fastness become better to cause less bleeding and beading, but the smoothness of the surface of the ink-receiving layer becomes lower and more haze and cracks occur to cause a decrease in reflection color density and glossiness. On the other hand, when the value of BET specific surface area/pore volume is greater, there is seen the tendency that the the smoothness becomes better, no cracks occur, and haze decreases more to increase transparency, so that the reflection color density becomes higher, but the ink absorptivity becomes lower to tend to cause bleeding and beading.

Based upon such tendencies and in order to obtain the recording medium that may hardly cause beading, the ink-receiving layer may preferably have a value of BET specific surface area/pore volume (i.e., the ratio of BET specific surface area to pore volume) within the range of from 50 to 500 $m^2$/ml, and taking account of the ink absorptivity and the anti-bleeding, preferably within the range of from 50 to 330 $m^2$/ml. If this ratio is greater than 330 $m^2$/ml, printed characters or letters may blur with time because of bleeding in some cases. Also, taking account of the color density and water fastness, the ratio may particularly preferably be within the range of from 80 to 250 $m^2$/ml. If it is greater than 250 $m^2$/ml, ink run is seen in some cases in the evaluation of water fastness described later. If on the other hand it is smaller than 80 $m^2$/ml, the color density tends to be lowered.

The BET specific surface area and the pore volume can be determined by the nitrogen adsorption-desorption method after the ink-receiving layer is subjected to deaeration for 24 hours at 120° C.

The reason why the beading can be made hardly occur in the recording medium having the ink-receiving layer having the value of BET specific surface area/pore volume within the specific range as stated above is presumed as follows.

Hitherto, a phenomenon where beading occurs less when the pore volume is larger is commonly observed. According to a finding of the present inventors, however, it can not always be said to be so, and additional factors have had to be taken into account.

As a result of extensive studies made by the present inventors, taking note of the BET specific surface area as an additional factor, it has been found that the beading can be made to occur less when the BET specific surface area is smaller.

Figures 1, 2A:
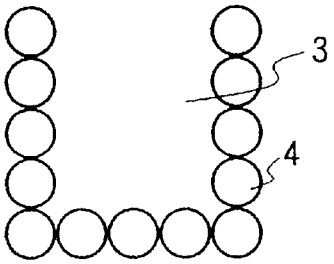
Figures 2, 2A:
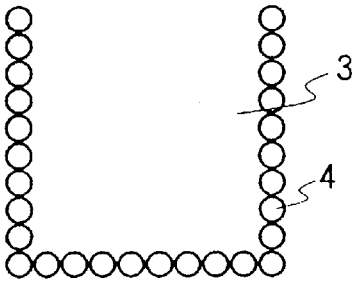

When viewed diagrammatically, this is considered to follow as shown in FIGS. 2A-1 and 2A-2. Namely, the fact that BET specific surface area relative to a certain pore volume is small means that the inner wall of a pore has a small number of irregularities, in other words, aggregated particles 4 that form a pore 3 are large (FIG. 2A-1). This can better prevent occurrence of beading. More specifically, the BET specific surface area is small in the case of FIG. 2A-1 and large in the case of FIG. 2A-2. The value of BET specific surface area/pore volume is small in the case of FIG. 2A-1 and great in the case of FIG. 2A-2. Beading does not occur in the case of FIG. 2A-1 and occurs in the case of FIG. 2A-2.

The reason why the beading occurs less when the aggregated particles that form a pore are larger is presumed as follows.

Figures 1, 2B:
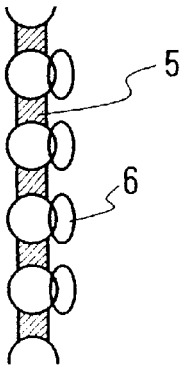
Figures 2, 2B:
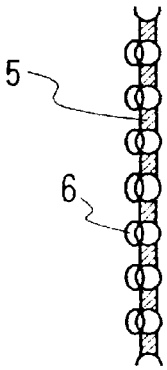

When the aggregated particles are small (FIGS. 2A-2 and 2B-2), the quantity of a binder 5 that mutually binds the aggregated particles that form the pore (or the proportion of the binder to the aggregated particles) is large and also the proportion of aggregated particles covered with the binder increases. The fact that the aggregated particles are small also means that the number of particles (primary particles) that are not bound through the binder is small. Therefore, in this case, the reason why the BET specific surface area is large is due to the fact that the binder portions 5 are also measured as the BET specific surface area of the pore, that is, apparent BET specific surface area is large. Hence, the smaller the aggregated particles are, the rather smaller the BET specific surface area of the particles 6 effective for the adsorption of ink is.

As is seen from the foregoing, there can be more ink adsorption points inversely when the aggregated particles are larger, so that the ink adsorption speed and ink absorption speed becomes higher. That is, it is considered that the ink is adsorbed and absorbed at a higher speed and hence the beading occurs less.

At the same time, as is also seen from the foregoing, it is considered that the adsorptivity of ink to the aggregated particles also becomes higher and hence the bleeding occurs less.

Taking account of the foregoing, the aggregated particles of the pigment may preferably have a particle diameter within the range of from 0.5 to 50 μm, and more preferably from 0.5 to 30 μm.

In order to control the ratio of BET specific surface area/pore volume of the ink-receiving layer within the specific range, it is preferable to adjust the total pore volume of the ink-receiving layer within the range of from 0.1 to 1.0 ml/g. If the pore volume of the ink-receiving layer is larger than the above range, cracks and dusting may occur in the ink-receiving layer. If it is smaller than the above range, the ink absorptivity tends to be lowered, and, especially when multi-color printing is performed, the ink may be overflowed from the ink-receiving layer to tend to cause an occurrence of image bleed.

The ink-receiving layer may preferably have a BET specific surface area within the range of from 20 to 450 $m^2/g$. If the BET specific surface area is smaller than this range, the gloss of the ink-receiving layer may decrease and the haze thereof may increase, and hence the resulting images may look hazy in white. If it is larger than the above range, cracks tend to occur in the ink-receiving layer.

Japanese Patent Application Laid-open No. 58-110287, previously noted, discloses a recording sheet having peaks in a pore distribution curve at two points, according to which the ink absorption speed can be made higher and images with a high resolution can be obtained, as so described. This publication, however, does not even suggest the present invention since it has no disclosure as to the idea according to the present invention, that the ratio of BET specific surface area/pore volume is adjusted within the specific range to prevent beading, and also has no description as to the BET specific surface area.

Japanese Patent Applications Laid-open No. 2-276670, No. 3-275378 and No. 5-32037 also disclose a recording sheet containing a synthesized alumina sol or a commercially available alumina sol (AS-2, AS-3, Alumina Sol 100), but have no description as to the BET specific surface area and by no means even suggest the present invention.

The pigment used in the recording medium of the present invention can be exemplified by inorganic pigments such as calcium carbonate, kaolin, talc, calcium sulfate, barium sulfate, titania, zinc oxide, zinc carbonate, aluminum silicate, alumina hydrates, silicic acid, sodium silicate, magnesium silicate, calcium silicate and silica, and organic pigments such as plastic pigments and urea resin pigments, as well as combinations of any of these.

Pigments particularly preferable from the viewpoint of ink absorptivity and image suitability such as resolution include an alumina hydrate and silica. The alumina hydrate has positive charges and hence it makes dyes in ink fix well and can provide images with a high gloss, a high image density and a good color. Thus, this is more preferable as the pigment used in the ink-receiving layer.

The alumina hydrate used in the present invention is a compound represented by the formula $$Al_2O_{3-n}(OH)_{2n}\cdot mH_2O.$$

In the formula, n represents any of integers 0, 1, 2 and 3, m represents a value of 0 to 10, and preferably 0 to 5. The group $mH_2O$ represents in many cases an eliminable aqueous phase that does not participate in the formation of crystal lattices, and hence the m may take a value which is not an integer. Upon calcination of alumina hydrates of this type, the m can reach the value of 0.

The alumina hydrate preferable for the working of the present invention includes alumina hydrates that prove non-crystal when analyzed by X-ray diffraction, and it is particularly preferable to use alumina hydrates disclosed in Japanese Patent Applications No. 5-125437, No. 5-125438, No. 5-125439 and No. 6-114571.

As the silica, natural silica, synthetic silica, amorphous silica or the like and chemically modified silica compounds may be used. Silica having positive charges is particularly preferred. For example, ADELITE CT-100 (trade name; available from Asahi Denka Kogyo K.K.), SNOWTEX (trade name; available from Nissan Chemical Industries, Ltd.) and so forth are commercially available and can be preferably used.

In the case of the alumina hydrate preferably used in the present invention, it has positive charges (cationic), and this is considered to more effectively act to prevent the beading. More specifically, as inks for ink-jet recording, as described later, water-soluble dyes having an anionic dissociative group are widely used, and it is presumed that an anionic dye having negative charges, contained in such inks, and the cationic alumina hydrate having positive charges combine by virtue of ionic attraction force. As the result, the alumina hydrate agglomerates, and hence its positive potential becomes greater (i.e., its cationic properties increase), so that the ionic attraction force further increases to make the ink adsorption speed and ink absorption speed higher, and this is considered to lead to the prevention of beading. Also, since the ink adsorptivity is further improved, the water fastness is also further improved, resulting in a further decrease also in bleeding.

A good recording medium that may hardly cause beading can be obtained when the aggregated particles are larger. If, however, the aggregated particles are too large, the haze may be caused by light scattering and also the smoothness may become poor, so that the images may look hazy in white. Hence, it is required for the aggregated particles to have an appropriate size as previously specified.

The alumina hydrate described above is subjected to adjustment of pore properties in its production process. In order to obtain the recording medium that has been made to hardly cause beading by satisfying the value of BET specific surface area/pore volume, it is preferable to use an alumina hydrate having a pore volume of from 0.1 to 1.0 ml/g. So long as the pore volume of the alumina hydrate is within the above range, the pore volume of the ink-receiving layer can be controlled with ease within the range as previously specified.

As to specific surface area, it is preferable to use an alumina hydrate having a specific surface area of from 40 to 500 $m^2/g$. So long as the specific surface area of the alumina hydrate is within the above range, the specific surface area of the ink-receiving layer can be controlled with ease within the range as previously specified.

In order to obtain a recording medium that may cause little or no beading, it is also important to use an alumina hydrate having a value of BET specific surface area/pore volume within a certain specific range, like that of the ink-receiving layer. In order to obtain the ink-receiving layer satisfying the stated range of BET specific surface area/pore volume, the alumina hydrate may preferably have a value of BET specific surface area/pore volume within the range of from 40 to 500 $m^2/ml$. In order to obtain an ink-receiving layer promising a higher color density and a satisfactory ink absorptivity in multi-color printing, it may preferably be within the range of from 40 to 300 $m^2/ml$. It may more preferably be within the range of from 65 to 120 $m^2/ml$ additionally taking account of preparation of coating solutions having a viscosity suited for coating since a coating solution prepared by mixing the binder described later has the tendency that its viscosity becomes higher and may increase with time at a great degree as the ratio of BET specific surface area/pore volume becomes smaller.

Here, the specific surface area and the pore volume can be determined by the nitrogen adsorption-desorption method after the alumina hydrate is subjected to deaeration for 24 hours at 120° C.

In the case when the alumina hydrate is used as the pigment, it is preferable to use an alumina hydrate whose aggregated particles have a zeta potential of 15 mV or higher, and preferably 20 mV or higher. If the aggregated particles of the alumina hydrate have a zeta potential lower than 15 mV, the particles may aggregate insufficiently, and hence the size of aggregated particles may become non-uniform to tend to increase the haze of the ink-receiving layer and tend to decrease the smoothness thereof.

The zeta potential of an aggregated particle of alumina hydrates can be commonly determined using a zeta potential measuring device.

As methods for preparing the aggregated particle of the pigment, any of the following methods can be used, from which at least one method may be selected as occasion calls.

(1) a method in which an electrolyte such as an anion, a cation or a salt is added to an aqueous dispersion containing the pigment, in an amount that may cause no thixotropy;

(2) a method in which the pigment is undergone self-agglomeration to produce secondary or tertiary, large xerogels, followed by wet-process or dry-process pulverization and further optionally classification;

(3) a method in which a shear force is applied to an aqueous dispersion containing the pigment, to effect agglomeration;

(4) a method in which an aqueous dispersion containing the pigment is once dried to form xerogls having bonds between primary particles;

(5) a method in which a dispersant such as an acid is added to hydrogels of the pigment, followed by dispersion until the pigment comes to have a given particle diameter;

(6) a method in which an organic substance or the like is added to the pigment, and the mixture obtained is granulated by graft polymerization or the like;

(7) a method in which urea-formalin resin or the like is added to a dispersion of the pigment to effect agglomeration; and (8) a method in which the pH of an aqueous dispersion containing the pigment is increased or decreased.

In the recording medium of the present invention, the binder used in combination with the above pigment may preferably be a water-soluble polymeric substance. For example, polyvinyl alcohol or modified products thereof (cationic modification, anionic modification or silanol modification), starch or modified products thereof (oxidation or etherification), gelatin or modified products thereof, casein or modified products thereof, cellulose derivatives such as carboxymethyl cellulose, gum arabic, hydroxyethyl cellulose and hydroxypropyl cellulose, conjugated diene copolymer latexes such as SBR latex, NBR latex and a methyl methacrylate butadiene copolymer, functional group modified latexes, vinyl copolymer latexes such as an ethylene vinyl acetate copolymer, polyvinyl pyrrolidone, maleic anhydride or copolymer thereof, and acrylic ester copolymers are preferred. Any of these binders may be used alone or in combination of plural kinds.

So long as the range of BET specific surface area/pore volume of the ink-receiving layer is satisfied, the pigment and the binder may be mixed in a weight ratio of from 1:1 to 30:1, and preferably from 5:1 to 20:1, within which any desired ratio may be selected. If the binder is in an amount less than the above range, the mechanical strength of the ink-receiving layer may become short to tend to cause cracking or dusting. If it is in an amount more than the above range, the pore volume may become small to tend to lower an ink absorptivity.

To a dispersion containing the pigment and the binder, it is possible to optionally add a dispersant, a thickening agent, a pH adjuster, a lubricant, a fluidity modifying agent, a surface active agent, a defoaming agent, a water-resisting agent, a foam controlling agent, a release agent, a foaming agent, a penetrating agent, a coloring dye, a fluorescent brightener, an ultraviolet absorbent, an antioxidant, an antiseptic agent and an antifungal agent.

As the water-resisting agent, it may be arbitrarily selected from known materials such as halogenated quaternary ammonium salts and quaternary ammonium salt polymers for its use.

As the base material (a support), papers such as sized paper, non-sized paper and resin-coated paper, sheetlike materials such as thermoplastic films, and cloths may be used, and there are no particular limitations.

In the case of thermoplastic films, it is possible to use transparent films such as polyester film, polystyrene film, polyvinyl chloride film, polymethyl methacrylate film, cellulose acetate film, polyethylene film and polycarbonate film, and also sheets made opaque by filling or fine-foaming with an alumina hydrate or titanium white.

When the resin-coated paper is used as the base material, the same touch, stiffness and texture as those of usual photographic prints can be obtained. Since also the recording medium of the present invention is provided with the ink-receiving layer having a high glossiness, the resulting printed materials can be fairly similar to usual photographic prints.

In order to improve adhesion between the base material and the ink-receiving layer, the base material may be subjected to a surface treatment such as corona treatment, or may be provided with a readily adherent layer as a subbing layer. In order to prevent curling, the base material may be provided at its back or a given portion, with an anticurl layer such as a resin layer or a pigment layer.

The ink-receiving layer is formed by coating on the base material a dispersion containing the pigment and the binder by means of a coater, followed by drying. The coating may be carried out by a process such as blade coating, air-knife coating, roll coating, brush coating, gravure coating, kiss coating, extrusion coating, slide hopper (slide bead) coating, curtain coating or spray coating.

The dispersion may be applied in an amount of from 0.5 to 60 g/m$^2$, and preferably from 5 to 45 g/m$^2$ in terms of dried solid matter. In order to obtain good ink absorptivity and resolution, it is useful to apply, it to form the ink-receiving layer in a thickness of 15 $\mu$m or more, preferably 20 $\mu$m or more, and particularly 25 $\mu$m or more.

Physical properties of pores (the BET specific surface area/pore volume ratio, the BET specific surface area and the pore volume) of the ink-receiving layer can be adjusted by controlling or selecting the conditions for producing the aggregated particles, the physical properties of pores possessed by the pigment itself, the type of the binder and the mixing ratio of the binder to the pigment. The particle diameter and particle size distribution of the pigment can be controlled when it is mixed with the binder, by controlling conditions for preparing the dispersion (e.g., dispersion machines, shear stress at the time of dispersion, dispersion time, heating temperature and humidity). This also enables control of the physical properties of pores of the ink-receiving layer. The physical properties of pores of the ink-receiving layer can be adjusted also by controlling coating conditions for forming the ink-receiving layer (e.g., coaters, coating solution temperature and humidity) and drying conditions (e.g., air flow, air strength, how to air, drying temperature, drying time, temperature gradation and humidity). The physical properties of pores of the ink-receiving layer can be adjusted from the above various factors, and of course how the beading may stand also changes.

Stated specifically, when, for example, the drying temperature is made lower, the value of BET specific surface area/pore volume becomes smaller, the ink absorptivity is more improved and the beading occur even less. In order to satisfy the numerical range of the physical properties of pores (the BET specific surface area/pore volume ratio, the BET specific surface area and the pore volume), the ink-receiving layer may be dried at a temperature of from 70 to 200° C., and preferably from 80 to 140° C., depending on the thermal fastness of the base material. The drying time also affects the physical properties of pores. If the ink-receiving layer is continued to be excessively dried after it has been well dried, the value of BET specific surface area/pore volume becomes greater, the ink absorptivity lowers and the beading tends to occur, depending on the thickness of the ink-receiving layer and the thermal conductivity of the base material. In order to satisfy the numerical range of the physical properties of pores, the drying time may preferably be set to range from 10 minutes to 30 minutes.

In the mixing ratio of the pigment to the binder, the more the binder is, the greater the value of BET specific surface area/pore volume of the ink-receiving layer becomes. Hence the ink absorptivity tends to be lowered and the beading tends to occur. Thus, in order to satisfy the numerical range of the physical properties of pores, the pigment and the binder may preferably be mixed in a weight ratio of from 1:1 to 30:1.

In order to satisfy the numerical range of the physical properties of pores, it is also necessary to control conditions for preparing the dispersion containing the pigment, to control the particle diameter and particle size distribution of the aggregated particles. Stated specifically, as the dispersion machine used, machines with gentle agitation such as a homomixer and a machine with a rotating blade are more preferable than grinding type dispersion machines such as a ball mill and a sand mill.

The shear stress may preferably be controlled to range from 0.1 to 100.0 $N/m^2$, which is variable depending on the viscosity, quantity or volume of the dispersion. If a shear force stronger than the above range is applied, the dispersion may gel, or the aggregated particles may break to form no aggregated particles having the appropriate size, so that the value of BET specific surface area/pore volume becomes greater than the above range to tend to cause beading. If a shear force weaker than the above range is applied, no sufficient dispersion may be carried out and giant aggregated particles exceeding the above range may remain, to tend to lower smoothness and gloss of the ink-receiving layer. Also, the value of BET specific surface area/pore volume becomes smaller than the above range to tend to cause haze and cracks and tend to cause a decrease in reflection color density.

The dispersion time may preferably be set to range from 5 minutes to 30 hours, which is variable depending on the quantity of the dispersion, the size of the container and the temperature of the dispersion. If the dispersion time is longer than 30 hours, the aggregated particles may break to form no aggregated particles having the appropriate size, so that the value of BET specific surface area/pore volume becomes greater than the above range to tend to cause beading. If the dispersion time is shorter than 5 minutes, giant aggregated particles exceeding the range specified above may remain, to tend to cause a lowering of smoothness and gloss of the ink-receiving layer.

The temperature of the dispersion may preferably be set to range from 10 to 100° C. during dispersion, in order to prepare the aggregated particles having the above size and to satisfy the above numerical range of the aggregated particles of the ink-receiving layer.

The ink used in the image forming method of the present invention mainly contains a coloring material (dye or pigment), a water-soluble organic solvent and water. As the dye, for example, a water-soluble dye as typified by direct dyes, acid dyes, basic dyes, reactive dyes and food dyes are preferable. Any of these may be used so long as they can provide images satisfying fixing performance, color performance, sharpness, stability, light-fastness and other required performances in combination with the recording medium.

The water-soluble dye is commonly dissolved in a solvent comprising water, or water and an organic solvent, when used. As these solvent components, a mixture of-water and a water-soluble organic solvent of various types may preferably be used, and may preferably be so controlled that the water content in the ink is within the range of from 20 to 90% by weight, and preferably from 60 to 90% by weight.

A solubilizing agent may also be added to the ink in order to dramatically improve dissolution of the water-soluble dye in the solvent. For the purpose of improving properties, it is also possible to add additives such as a viscosity modifier, a surface active agent, a surface tension modifier, a pH adjuster, a resistivity modifier and a storage stabilizer.

An image forming method comprising imparting the above ink to the above recording medium to make a record may preferably be a method that carries out an ink-jet recording process. This recording process may be of any type so long as it is a process that can effectively release ink droplets from nozzles to impart the ink to the recording medium. In particular, the process disclosed in Japanese Patent Application Laid-open No. 54-59936 can be effectively used, which is an ink-jet recording system in which an ink having undergone the action of heat energy changes abruptly in volume and the ink is ejected from nozzles by the force of action attributable to this change in state.

The present invention will be described below in greater detail by giving Examples. The present invention is by no means limited to these.

Production of Alumina Hydrate

Aluminum dodecyloxide was produced by the method disclosed in U.S. Pat. No. 4,242,271. Next, the aluminum dodecyloxide obtained was hydrolyzed to produce an alumina slurry by the method disclosed in U.S. Pat. No. 4,202,870. To this alumina slurry, water was added until the solid content of alumina hydrate reached 7.9%. The alumina slurry had a pH of 9.5. A 3.9% nitric acid solution was added to adjust the pH. Colloidal sols were obtained under aging conditions as respectively shown in Table 1. These colloidal sols were spray-dried at 75° C. to obtain alumina hydrates (A) to (E). The BET specific surface area (SA), pore volume (PV) and value of BET specific surface area/pore volume (SA/PV) of these alumina hydrates were determined by the method described later, to obtain the results as shown in Table 1.

EXAMPLES 1 to 8

The above alumina hydrates (A) to (E) and colloidal silica (ADELITE CT-100, trade name; available from Asahi Denka Kogyo K.K.; herein called "alumina hydrate (F)") were respectively dispersed in ion-exchanged water to obtain dispersions (solid matter concentration: 15%). To each of the above dispersions an aqueous ammonia solution was added to increase a pH each by +1. Thereafter, in these dispersions, an aqueous solution (solid matter concentration: 10%) prepared by dissolving polyvinyl alcohol (GOHSENOL NH-18, trade name; available from Nihon Gosei Kagaku Co., Ltd.) in ion-exchanged water, weighed so as to be in various solid matter weight ratios (P/B ratio=solid matter weight of alumina hydrate/solid matter weight of polyvinyl alcohol), was mixed and stirred to obtain mixed dispersions.

The resulting dispersions were respectively applied on white polyester films having a thickness of 100 $\mu$m (Lumirror X-21, trade name; available from Toray Industries, Inc.), followed by drying under various drying conditions (temperature and time) as shown in Table 2, to form ink-receiving layers with a dried coating thickness of 30 $\mu$m. Thus, recording mediums of the present invention were produced.

On the recording mediums thus obtained, various physical properties were measured by the methods as described later, to make evaluation to obtain the results as shown in Table 2.

Reference Example 1

Using the alumina hydrate (A) as the pigment, a recording medium was produced in the same manner as in Example 1 except that the mixing ratio to the polyvinyl alcohol was changed to P/B=8/1. Its various physical properties were measured to obtain the results as shown in Table 2.

Reference Example 2

Using the alumina hydrate (E) as the pigment, a recording medium was produced in the same manner as in Example 7 except that the mixing ratio to the polyvinyl alcohol was changed to P/B=16/1 and the drying temperature was changed to 120° C. Its various physical properties were measured to obtain the results as shown in Table 2.

Evaluation items:

1) Pore volume (PV), BET specific surface area (SA) and BET specific surface area/pore volume (SA/PV), particle diameter and zeta potential The pore volume was measured by the nitrogen adsorption-desorption method after the ink-receiving layer was subjected to deaeration for 24 hours at 120° C. (using AUTOSOBE I, manufactured by Quanthachrome Co.).

The BET specific surface area was determined by calculation using the Brunauer-Emmet-Teller equation.

The value of BET specific surface area/pore volume was determined by calculation using the respective values obtained.

The pore volume and BET specific surface area of the alumina hydrates were also determined similarly.

With regard to the particle diameter, the alumina hydrates were dispersed in ion-exchanged water and thereafter the aggregated particles formed were measured using BI-90, manufactured by Brookheaven Co.

With regard to the zeta potential, the alumina hydrates were respectively dispersed in ion-exchanged water and thereafter, the pH of the dispersions being adjusted to 6, the aggregated particle formed was measured using Bi-ZETA plus, manufactured by Brookheaven Co.

2) State of coating of ink-receiving layer

Evaluated by visual observation. An instance where a smooth surface is obtained and in a good state was evaluated as "A"; and an instance where the surface is rough or cracked, as "C"

3) Print characteristics

Using a bubble jet printer having ink-jet heads corresponding to four colors, Y (yellow), M (magenta), C (cyan) and Bk (black), provided with 128 nozzles at nozzle intervals of 16 nozzles per 1 mm, ink-jet recording was carried out using inks having the composition shown below, and evaluation was made on ink absorptivity, image density, anti-bleeding and anti-beading.

(a) Ink absorptivity

Solid prints were printed in monochromes or multi-colors using Y, M, C and Bk inks having the composition shown below, and immediately thereafter the recorded areas were touched with the fingers to examine how the inks dried on the surface of the recording mediums. The ink quantity in the monochrome printing was regarded as 100%. An instance where no ink adheres to the fingers in an ink quantity of 300% was evaluated as "AA"; an instance where no ink adheres to the fingers in an ink quantity of 200%, as "A"; and an instance where no ink adheres to the fingers in an ink quantity of 100%, as "B".

(b) Image density

Solid prints were printed using the magenta ink having the composition shown below, to evaluate their image density by the use of Macbeth Reflection Densitometer RD-918 (the magenta image density was lowest among the four colors in all Examples and hence used here as the image density to be evaluated).

(c) Anti-bleeding and anti-beading

Solid prints were printed in monochromes or multi-colors using Y, M, C and Bk inks having the composition shown below, and thereafter any bleeding and beading on the surfaces of the recording mediums were visually observed to make evaluation. The ink quantity in the monochrome printing was regarded as 100%. An instance where neither bleeding nor beading occurs in an ink quantity of 400% was evaluated as "AA"; an instance where neither bleeding nor beading occurs in an ink quantity of 200% was evaluated as "A"; an instance where neither bleeding nor beading occurs in an ink quantity of 100% was evaluated as "B".

Here, the "ink quantity of 400%" corresponds to the ink quantity necessary for 30 ng of ink to be imparted to the recording medium at 32×32 dots per 1 2 mm$^2$.

Ink composition:

| | |
|---|---|
| Dyes* | 5 parts |
| Ethylene glycol | 10 parts |
| Polyethylene glycol | 10 parts |
| Water | 75 parts |

*Dyes used:
Y; C.I. Direct Yellow 86
M; C.I. Acid Red 35
C; C.I. Direct Blue 199
Bk; C.I. Food Black 2

(d) Water fastness of images

Solid prints were printed in monochrome using the magenta ink having the above composition, and thereafter the recording medium was immersed in running water for 3 minutes, followed by air drying. Water-resisting degree was found according to the following expression.

$$\text{Water-resisting degree} = \frac{\text{Image density after immersion in running water}}{\text{Image density before immersion in running water}} \times 100$$

An instance where the value of this water-resisting degree is 95% or more was evaluated as "AA"; an instance where it is 88% or more to less than 95%, as "A"; and an instance where it is less than 88%, as "B" (the water fastness of magenta prints was lowest among the four colors in all Examples and hence used here as the water fastness to be evalualuated).

TABLE 1

| Pigment: | (A) | (B) | (C) | (D) | (E) | (F) |
|---|---|---|---|---|---|---|
| pH before aging: | 6.7 | 6.9 | 6.8 | 7.0 | 6.9 | — |
| Aging temperature (° C.): | 70 | 90 | 110 | 130 | 130 | — |
| Aging period (hour): | 20 | 16 | 6 | 5 | 3 | — |
| Aging device: | Oven | Oven | Oven | Autoclave | Autoclave | — |
| SA ($m^2$/g): | 60.7 | 72.5 | 200.2 | 251.0 | 359.2 | 221.1 (catalog value) |
| PV (ml/g): | 0.79 | 0.70 | 0.71 | 0.74 | 0.73 | — |
| SA/PV ($m^2$/ml): | 77 | 104 | 282 | 339 | 492 | — |
| Particle diameter (μm): | 30 | 26 | 16 | 12 | 10 | 20 |
| Zeta potential (mV): | 52 | 47 | 32 | 27 | 23 | — |

TABLE 2

| | Example | | | | | | | | Reference Example | |
|---|---|---|---|---|---|---|---|---|---|---|
| | 1 | 2 | 3 | 4 | 5 | 6 | 7 | 8 | 1 | 2 |
| Pigment: | (A) | (B) | (B) | (B) | (C) | (D) | (E) | (F) | (A) | (E) |
| P/B ratio: | 15/1 | 15/1 | 15/1 | 19/1 | 15/1 | 15/1 | 16/1 | 7/1 | 8/1 | 16/1 |
| SA ($m^2$/g): | 46.1 | 79.3 | 143.5 | 149.5 | 171.1 | 214.8 | 308.0 | 207.5 | 28.7 | 337.9 |
| PV (ml/g): | 0.64 | 0.62 | 0.60 | 0.65 | 0.62 | 0.60 | 0.63 | 0.58 | 0.61 | 0.62 |
| SA/PV: | 72 | 128 | 239 | 230 | 276 | 358 | 481 | 357 | 47 | 545 |
| Drying conditions: | 100° C. 15 min | 100° C. 15 min | 120° C. 25 min | 100° C. 15 min | 100° C. 15 min | 100° C. 15 min | 100° C. 15 min | 100° C. 20 min | 100° C. 15 min | 120° C. 15 min |
| State of coating: | A | A | A | A | A | A | A | A | C | A |
| Ink absorptivity: | AA | AA | AA | AA | AA | A | A | A | AA | B |
| Image density: | 1.78 | 1.85 | 1.84 | 1.90 | 1.90 | 1.88 | 1.86 | 1.70 | 1.69 | 1.86 |
| Anti-bleeding: | AA | AA | AA | AA | AA | A | A | A | AA | B |
| Anti-beading: | AA | AA | AA | AA | AA | AA | AA | AA | AA | B |
| Water fastness: | AA | AA | AA | AA | A | A | B | A | AA | B |
| Others: | *1 | | | | *2 | *2 *3 | *2 *3 | | *4 *1 | *2, *3 *5 |

*1 White haze;
*2 Highly viscous coating solution;
*3 Viscosity increase with time;
*4 Cracks;
*5 Bleeding (phenomenon where inks with different colors mix one another at color boundaries)

As described above, the present invention has the following advantages.

1) The use of the recording medium having the ink-receiving layer whose value of BET specific surface area/pore volume is within the specific range can prevent beading and make bleeding occur less to provide good images.

2) The use of the recording medium having the ink-receiving layer whose value of BET specific surface area/pore volume is within the specific range brings about an improvement in water fastness of images.

What is claimed is:

1. An image forming method comprising ejecting minute droplets of an ink from fine orifices to impart the ink droplets to a recording medium to make a print, wherein said recording medium comprises a base material, and an ink-receiving layer thereon containing a pigment of an aggregated particle having a particle diameter of from 0.5 to 50 μm and a binder, wherein said ink-receiving layer has a value of BET specific surface area/pore volume within the range of from 50 to 500 $m^2$/ml.

2. The image forming method according to claim 1, wherein said ink-receiving layer has a value of BET specific surface area/pore volume within the range of from 50 to 330 $m^2$/ml.

3. The image forming method according to claim 1, wherein said ink-receiving layer has a value of BET specific surface area/pore volume within the range of from 80 to 250 $m^2$/ml.

4. The image forming method according to claim 1, wherein said ink-receiving layer has a BET specific surface area within the range of from 20 to 450 $m^2$/g.

5. The image forming method according to claim 1, wherein said ink-receiving layer has a pore volume within the range of from 0.1 to 1.0 ml/g.

6. The image forming method according to claim 1, wherein said pigment comprises an alumina hydrate.

7. The image forming method according to claim 6, wherein an aggregated particle of said alumina hydrate has a zeta potential of 15 mV or higher at pH 6.

8. The image forming method according to claim 6, wherein an aggregated particle of said alumina hydrate has a zeta potential of 20 mV or higher at pH 6.

9. The image forming method according to claim 6, wherein said alumina hydrate has a value of BET specific surface area/pore volume within the range of from 40 to 500 $m^2$/ml.

10. The image forming method according to claim 6, wherein said alumina hydrate has a value of BET specific surface area/pore volume within the range of from 40 to 300 $m^2$/ml.

11. The image forming method according to claim 6, wherein said alumina hydrate has a value of BET specific surface area/pore volume within the range of from 65 to 120 $m^2$/ml.

12. The image forming method according to claim 6, wherein said alumina hydrate has a BET specific surface area within the range of from 40 to 500 $m^2$/g.

13. The image forming method according to claim 6, wherein said alumina hydrate has a pore volume within the range of from 0.1 to 1.0 ml/g.

14. The image forming method according to claim 1, wherein said pigment comprises silica.

15. An image forming method comprising ejecting minute droplets of an ink from fine orifices to impart the ink droplets to a recording medium to make a print, wherein said recording medium comprises a base material, and an ink-receiving layer thereon containing a pigment of an aggregated particle having a particle diameter of from 0.5 to 50 $\mu$m and a binder, wherein said pigment is an alumina hydrate and said ink-receiving layer has a value of BET specific surface area/pore volume within the range of from 50 to 500 $m^2$/ml.

16. The image forming method according to claim 15, wherein said ink-receiving layer has a value of BET specific surface area/pore volume within the range of from 50 to 330 $m^2$/ml.

17. The image forming method according to claim 15, wherein said ink-receiving layer has a value of BET specific surface area/pore volume within the range of from 80 to 250 $m^2$/ml.

18. The image forming method according to claim 15, wherein said ink-receiving layer has a BET specific surface area within the range of from 20 to 450 $m^2$/g.

19. The image forming method according to claim 15, wherein said ink-receiving layer has a pore volume within the range of from 0.1 to 1.0 ml/g.

20. The image forming method according to claim 15, wherein aggregated particles of said alumina hydrate have a zeta potential of 15 mV or higher at pH 6.

21. The image forming method according to claim 15, wherein aggregated particles of said alumina hydrate have a zeta potential of 20 mV or higher at pH 6.

22. The image forming method according to claim 15, wherein said alumina hydrate has a value of BET specific surface area/pore volume within the range of from 40 to 500 $m^2$/ml.

23. The image forming method according to claim 15, wherein said alumina hydrate has a value of BET specific surface area/pore volume within the range of from 40 to 300 $m^2$/ml.

24. The image forming method according to claim 15, wherein said alumina hydrate has a value of BET specific surface area/pore volume within the range of from 65 to 120 $m^2$/ml.

25. The image forming method according to claim 15, wherein said alumina hydrate has a BET specific surface area within the range of from 40 to 500 $m^2$/g.

26. The image forming method according to claim 15, wherein said alumina hydrate has a pore volume within the range of from 0.1 to 1.0 ml/g.

27. The image forming method according to any one of claims 1 to 26, wherein said ink droplets are ejected by an ink-jet recording system.

28. The image forming method according to claim 27, wherein said ink-jet recording system is a system in which a heat energy is acted on the ink so that the ink droplets are ejected.

* * * * *

UNITED STATES PATENT AND TRADEMARK OFFICE

CERTIFICATE OF CORRECTION

PATENT NO. : 6,000,794

DATED : December 14, 1999

INVENTOR(S) : YUJI KONDO, ET AL.

It is certified that error appears in the above-identified patent and that said Letters Patent is hereby corrected as shown below:

COLUMN 4:

Line 58, "becomes" should read --become--.

COLUMN 7:

Line 36, "xerogls" should read --xerogels--.

COLUMN 8:

Line 55, "apply," should read --apply--.

COLUMN 10:

Line 27, "of-water" should read --of water--.

UNITED STATES PATENT AND TRADEMARK OFFICE

CERTIFICATE OF CORRECTION

PATENT NO. : 6,000,794

DATED : December 14, 1999

INVENTOR(S) : YUJI KONDO, ET AL.

It is certified that error appears in the above-identified patent and that said Letters Patent is hereby corrected as shown below:

COLUMN 12:

Line 5, "C" should read --"C".--.

Signed and Sealed this

Seventh Day of November, 2000

*Attest:*

Q. TODD DICKINSON

*Attesting Officer*

*Director of Patents and Trademarks*